US011858772B2

(12) United States Patent
Lee

(10) Patent No.: US 11,858,772 B2
(45) **Date of Patent: *Jan. 2, 2024**

(54) STRIP CUTTING APPARATUS FOR DIAGNOSTIC REAGENT KIT

(71) Applicants: Seokhyun Lee, Seoul (KR); Wonha Lee, Seoul (KR)

(72) Inventor: Seokhyun Lee, Seoul (KR)

(73) Assignees: Seokhyun Lee, Seoul (KR); Wonha Lee, Seoul (KR)

( * ) Notice: Subject to any disclaimer, the term of this patent is extended or adjusted under 35 U.S.C. 154(b) by 168 days.

This patent is subject to a terminal disclaimer.

(21) Appl. No.: 17/411,233

(22) Filed: Aug. 25, 2021

(65) Prior Publication Data

US 2022/0063951 A1 Mar. 3, 2022

(30) Foreign Application Priority Data

Aug. 28, 2020 (KR) ..... 10-2020-0109031

(51) Int. Cl.
*B65H 35/00* (2006.01)

(52) U.S. Cl.
CPC ..... *B65H 35/0086* (2013.01)

(58) Field of Classification Search
CPC ..... B26D 1/14; B26D 1/141; B26D 1/125; B26D 1/12; B26D 1/045; B26D 1/24; B26D 1/245; B26D 1/36; B26D 1/365; B26D 7/265; B23D 19/04; B23D 19/06; B65H 35/0086
See application file for complete search history.

(56) References Cited

U.S. PATENT DOCUMENTS

| | | | | |
|---|---|---|---|---|
| 3,960,335 A * | 6/1976 | Haberle | B02C 18/142 241/221 |
| 4,805,506 A * | 2/1989 | Gosnell | B23D 35/004 83/507 |
| 5,085,110 A | 2/1992 | Scholtysik et al. | |

FOREIGN PATENT DOCUMENTS

| | | |
|---|---|---|
| CN | 103707340 | 4/2014 |
| JP | 2001-198883 | 7/2001 |
| JP | 2001341095 | 12/2001 |
| JP | 2009136930 A * | 6/2009 |
| JP | 2015-93334 | 5/2015 |
| KR | 20120111427 A * | 10/2012 |
| KR | 101277870 B1 * | 6/2013 |
| KR | 20140108009 A * | 9/2014 |
| KR | 10-2016-0030645 | 3/2016 |
| KR | 10-2018-0014521 | 2/2018 |
| KR | 10-2031214 | 10/2019 |
| KR | 10-2196059 | 12/2020 |

* cited by examiner

*Primary Examiner* — Jennifer S Matthews
(74) *Attorney, Agent, or Firm* — LEX IP MEISTER, PLLC

(57) ABSTRACT

An apparatus for cutting diagnostic reagent strips includes first and second shafts with facing knife blades and spacers. A guide between the shafts ensures accurate, defect-free cutting. Adjusting screws fine-tune the shaft interval for enhanced cutting.

6 Claims, 8 Drawing Sheets

STRIP CUTTING APPARATUS FOR DIAGNOSTIC REAGENT KIT

BACKGROUND OF THE INVENTION

Field of the Invention

The present invention relates to a strip cutting apparatus for a diagnostic reagent kit which can cut a bandlike diagnostic reagent kit into a diagnostic strip of a predetermined size, and more particularly, to a strip cutting apparatus for a diagnostic reagent kit that includes two shafts, each of which has knives and spacers arranged in such a way that one spacer and two knives having blades facing each other are fit into the shaft alternatively, and a guide member mounted to go between the two shafts to support both sides of a diagnostic reagent, so as to cleanly cut the diagnostic reagent into strips in a state where the guide member stably supports both sides of the diagnostic reagent, thereby removing defect by preventing the strips from riding up and preventing the cut strips from being twisted or bent. Additionally, the present invention relates to a strip cutting apparatus for a diagnostic reagent kit that an angle of a cutting edge of each knife, which substantially performs a cutting action of the blade, is larger than an angle of the blade, so that both edges of each cut strip are supported stably, thereby cutting the diagnostic reagent into the strips without deformation, twisting or bending.

Background Art

In general, a diagnostic strip (kit) is manufactured into a bandlike diagnostic reagent kit, and such a diagnostic reagent kit is cut by various cutting apparatuses as described in the following patent documents 1 to 3.

(Patent Document 1) Korean Patent No. 10-1617095

Disclosed is a strip cutting apparatus for a diagnostic reagent kit. The apparatus includes: a cutter having an upper knife and a lower knife for cutting a diagnostic card; a cutter driving unit for making the upper knife move reciprocally in a vertical direction in order to continuously acquire a first diagnostic strip and a second diagnostic strip from the diagnostic card; a diagnostic card conveying unit for moving the diagnostic card to a cut area between the upper knife and the lower knife step by step; a first vacuum block and a second vacuum block for respectively grasping the first diagnostic strip and the second diagnostic strip; and a diagnostic strip unloader which moves the first vacuum block and the second vacuum block from the cut area to an unload area and expands a gap between the first vacuum block and the second vacuum block.

(Patent Document 2) Korean Patent No. 10-1859280

Disclosed is a strip cutting apparatus for a diagnostic reagent kit. The apparatus includes: an upper cutting roller having upper circular blades for cutting a diagnostic card into a plurality of diagnostic strips; a lower cutting roller having lower circular blades corresponding to the upper circular blades; a cleaning fluid supply unit arranged above the upper cutting roller to supply cleaning fluid to remove foreign matters on the upper and lower circular blades; and a recovery container arranged below the lower cutting roller for collecting the cleaning fluid and the foreign matters removed from the upper and lower circular blades.

(Patent Document 3) Korean Patent No. 10-2031214

Disclosed is a test strip cutting and examining apparatus for manufacturing an invitro diagnostic kit. The test strip cutting and examining apparatus for manufacturing the invitro diagnostic kit includes: a supply unit which senses a correct positioning of an uncut sheet with a first camera; a circular rotation cutting device which cuts the uncut sheet at the rear end of the supply unit to form a plurality of strips; a strip supply and demand unit formed at the rear end of the circularly rotating cutter to move the strips by separating an interval between the strips; and a strip defect determining unit which is formed at a side of the strip demanding and supplying unit to check a defect of a membrane surface of the strip. Therefore, the test strip cutting and examining apparatus for manufacturing the invitro diagnostic kit can simultaneously manufacture the plurality of strips by cutting the uncut sheet without interference of a worker, and automatically check strip manufacturing and strip defects by rapidly checking defects of the plurality of strips. The test strip cutting and examining apparatus for manufacturing the invitro diagnostic kit automatically confirms manufacturing of the plurality of strips and the defects of the plurality of strips by a simple step of entering the uncut sheet to the supplying unit, improves a defect checking rate and a product performance by checking a defect test by a second camera, manufactures the uncut sheet to the plurality of strips, easily and automatically checks the strip having the defect on the membrane surface by using the strip defect determining unit, and reduces manufacturing costs without destruction of the uncut sheet while improving production efficiency.

However, such conventional cutting methods which cut several strips by inserting the diagnostic reagent between two rollers have the following disadvantages.

First, like several scissors cut several strips at once, because the diagnostic reagent is cut by two knifes, the cut strips may be leaned or bent to one side.

Second, the strip cut from the diagnostic reagent is stuck between the knifes, so is bent, twisted or stuck according to rotation of the shaft, and it may cause poor cutting.

Third, there is nothing wrong with using the strip, which is bent or leaned to one side, for the purpose of diagnosis, but it is difficult to put the bent strip into a diagnostic kit when the bent strip is used in a designated position of the diagnostic kit.

Fourth, strips manufactured by the conventional cutting methods cannot be used in the diagnostic kit since being bent or twisted, have a high defect rate, and deteriorate manufacturing efficiency of diagnostic kits.

PATENT LITERATURE

Patent Documents

Patent Document 1: Korean Patent No. 10-1617095 (granted on Apr. 25, 2016)

Patent Document 2: Korean Patent No. 10-1859280 (granted on May 11, 2018)

Patent Document 3: Korean Patent No. 10-2031214 (granted on Oct. 4, 2019)

SUMMARY OF THE INVENTION

Accordingly, the present invention has been made to solve the above-mentioned problems occurring in the prior arts, and it is an object of the present invention to provide a strip cutting apparatus for a diagnostic reagent kit that includes first and second shafts, each of which has knives and spacers arranged in such a way that two knives having blades facing each other and one spacer are fit into the shaft alternatively, and a guide member mounted to go between the first and second shafts to guide a diagnostic reagent, thereby accurately cutting the diagnostic reagent into strips of an approximately rectangular shape in a diagnostic reagent passing section and removing defect by preventing the strips from being twisted or bent.

It is another object of the present invention to provide a strip cutting apparatus for a diagnostic reagent kit that the guide member continuously guides the diagnostic reagent till the diagnostic reagent is cut into strips in order to prevent the cut strips being fit between the rotating knives, thereby removing defect by preventing the cut strips being deformed, twisted or bent.

It is a further object of the present invention to provide a strip cutting apparatus for a diagnostic reagent kit that has adjusting screws mounted at both ends of the first shaft supported by thrust bearings in order to adjust an interval between the first and second shafts in a longitudinal direction, thereby more accurately adjusting the interval between the first and second shafts to enhance cutting effect of the strips.

To accomplish the above object, according to the present invention, there is provided a strip cutting apparatus for a diagnostic reagent kit which cuts a plate-shaped diagnostic reagent into several bandlike strips in a width direction at a time, the strip cutting apparatus including: a frame; a first shaft which is formed in a disc shape, includes a plurality of spacers and a plurality of knives, which has blades 211 getting in contact with each other and facing each other, and an adjusting nut coupled and fastened to at least one side thereof so that the knives and the spacers do not get out of the first shaft, the spacers and the knives being fixed in such a way that two knives and one spacer are fit into the first shaft alternately not to rotate; a second shaft which is formed in a disc shape, includes a plurality of spacers and a plurality of knives, which has blades 211 getting in contact with each other and facing each other, and an adjusting nut coupled and fastened to at least one side thereof so that the knives and the spacers do not get out of the second shaft, the spacers and the knives being fixed in such a way that two knives and one spacer are fit into the second shaft alternately not to rotate; and a guide member, which includes a first guide mounted on the spacer of the first shaft and a second guide mounted on the spacer of the second shaft, the guide member supporting a diagnostic reagent so that the diagnostic reagent is cut when the diagnostic reagent goes between the first shaft and the second shaft, wherein the knives are mounted to rotate on the frame to cut the diagnostic reagent into several strips by shearing force when the first shaft and the second shaft rotate on the frame in place at the same time, and at least two concentricity adjusting screws are coupled to the adjusting nuts of the first shaft and the second shaft on a virtual circle based on the first shaft in order to adjust concentricity by pushing the knives and the spacers in a width direction.

Especially, a first angle which is formed by a cutting edge formed at an edge of the knife is larger than a second angle which is formed by the blade.

In this instance, the first angle is within the range of 43° to 47°, and the second angle is within the range of 8° to 12°.

Moreover, a compression spring, a tapered bearing, a bearing and a thrust bearing are mounted on one side of the first shaft in order, the thrust bearing has an adjusting screw mounted on the first shaft to rotate in place in order to adjust the length. Another bearing for supporting rotation and longitudinal movement of the first shaft, another adjusting screw mounted on the frame, and another thrust bearing for rotatably supporting the first shaft according to in-place rotation of the adjusting screw are mounted on the other side of the first shaft.

The strip cutting apparatus for a diagnostic reagent kit according to the present invention has the following effects.

First, the strip cutting apparatus for a diagnostic reagent kit can remove defect by cutting the diagnostic reagent into strips formed in an approximately rectangular shape in the section where the diagnostic reagent passes since the guide member is mounted to go between the two shafts used to cut the diagnostic reagent and the two knives having the blades facing each other cut the diagnostic reagent, so that the cut strips are not separated or twisted.

Second, the strip cutting apparatus for a diagnostic reagent kit can easily put the cut strips into the diagnostic kit while keeping the form of the rectangular strips by preventing the cut strips from being bent or twisted since the guide member prevents the cut strips from being entangled in the rotational direction of the first shaft or the second shaft.

Third, the strip cutting apparatus for a diagnostic reagent kit can easily adjust the interval between the knives of the first shaft and the knives of the second shaft and accurately and correctly adjust the interval since adjusting components are mounted at both sides of the first shaft to adjust the location of the first shaft in the longitudinal direction.

Fourth, the strip cutting apparatus for a diagnostic reagent kit can accurately adjust concentricity of the knives in the unit of 0.01 mm by changing a rotation amount into a straight line since the adjusting screws adjust in a threaded type.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Hereinafter, preferred embodiments of the present invention will be described in detail with reference to the accompanying drawings. Particular terms may be defined to describe the invention in the best manner. Accordingly, the meaning of specific terms or words used in the specification and the claims should not be limited to the literal or commonly employed sense, but should be construed in accordance with the spirit of the invention as described herein.

The description of the various embodiments is to be construed as exemplary only and does not describe every possible instance of the invention. Therefore, it should be understood that various changes may be made and equivalents may be substituted for various elements of the invention.

Figure 1A:
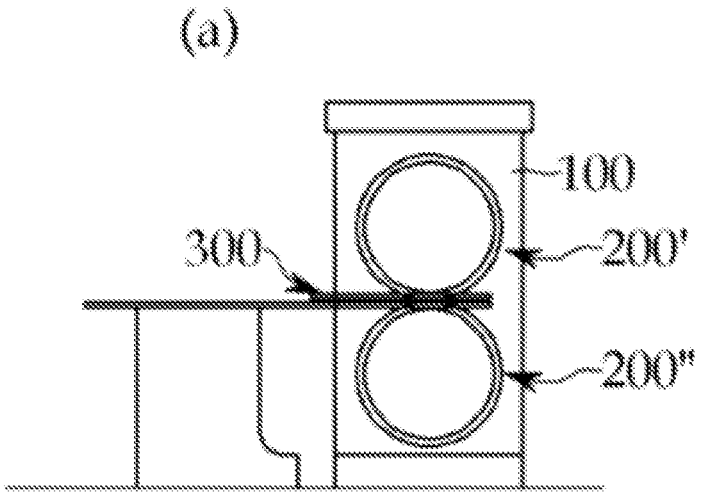
FIGS. 1(*a*) and 1(*b*) are side views showing a state where a diagnostic reagent kit is put into a strip cutting apparatus for a diagnostic reagent kit according to a first preferred embodiment of the present invention and is cut into strips.
Figure 1B:
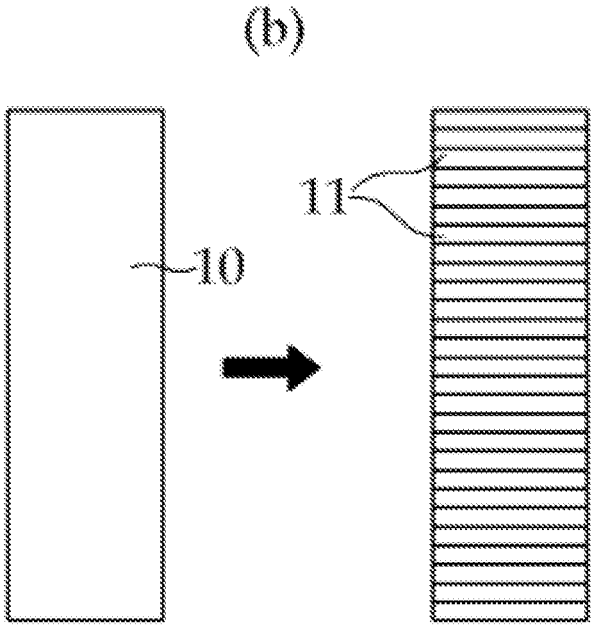

As shown in FIGS. 1(*a*) to 7, a strip cutting apparatus for a diagnostic reagent kit according to a first preferred embodiment of the present invention is to cut a diagnostic reagent 10, which is provided in the form of a long plate, into several bandlike strips 11 by cutting in a width direction, and includes a frame 100, a first shaft 200', a second shaft 200", and a guide member 300.

Especially, the guide member 300 is mounted to penetrate between the first shaft 200' and the second shaft 200" to support both sides of a diagnostic reagent 10, and the diagnostic reagent 10 is cut into strips 11 while the first shaft 200' and the second shaft 200" having blades 211 facing each other rotate. Therefore, the strip cutting apparatus for a diagnostic reagent kit according to the first preferred embodiment of the present invention can cut the diagnostic reagent 10 into the strips 11 of a predetermined shape in the state where both sides of the diagnostic reagent 10 are supported, prevent defects caused when the cut strips 11 are twisted, not cut, or bent by being stuck between the knifes 210' by rotation of the first shaft 200' or the second shaft 200".

Moreover, the first shaft 200' has at least two concentricity adjusting screws 231 coupled to an adjusting nut 230 for fixing two knifes 210, which have the blades facing each other, and a spacer 210" mounted on the first shaft 200' alternately. When the adjusting nut 230 cannot uniformly press the knifes 210' and the spacer 210", the concentricity adjusting screw 231 can press the knifes 210" and the spacer 210" to adjust concentricity.

Furthermore, the first shaft 200' has adjusting screws 271 mounted at both ends thereof in order to move in a longitudinal direction of the first shaft 200', so that the knifes 210' disposed between the first shaft 200' and the second shaft 200" can be adjusted to engage each other accurately.

Hereinafter, referring to the drawings, the structure will be described in more detail as follows. Here, the reference numeral 10 indicates a bandlike diagnostic reagent having reagent at one side for diagnosis, and the reference numeral 11 indicates several bandlike strips cut from the diagnostic reagent.

A. Frame

As shown in FIGS. 1(*a*), 1(*b*) and 2, the frame 100 supports the first shaft 200' and the second shaft 200" which will be described later, and the guide member 300, and the diagnostic reagent 10 is put between the first shaft 200' and the second shaft 200" so as to be cut into several strips 11. As described above, the frame 100 can be manufactured in any form if it can support both ends of the first shaft 200' and the second shaft 200". In the drawings, an example of a lattice-shaped frame is illustrated.

B. First Shaft and Second Shaft

As shown in FIGS. 1(*a*) to 3, the first shaft 200' and the second shaft 200" are mounted such that both ends can rotate in place on the frame 100, and one diagnostic reagent 10 is put on the outer circumferences of the first shaft 200' and the second shaft 200" so that they can be cut into several strips 11 at once.

Here, because the first shaft 200' and the second shaft 200" have the same structure, the first shaft 200' will be described, and detailed description of the second shaft 200" will be omitted. Additionally, as shown in FIG. 3, the first shaft 200' and the second shaft 200" may be formed to rotate in place, but it is preferable that the first shaft 200' and the second shaft 200" be rotated simultaneously by the medium of a gear 220 engaging the first shaft 200' and the second shaft 200".

Figure 2:
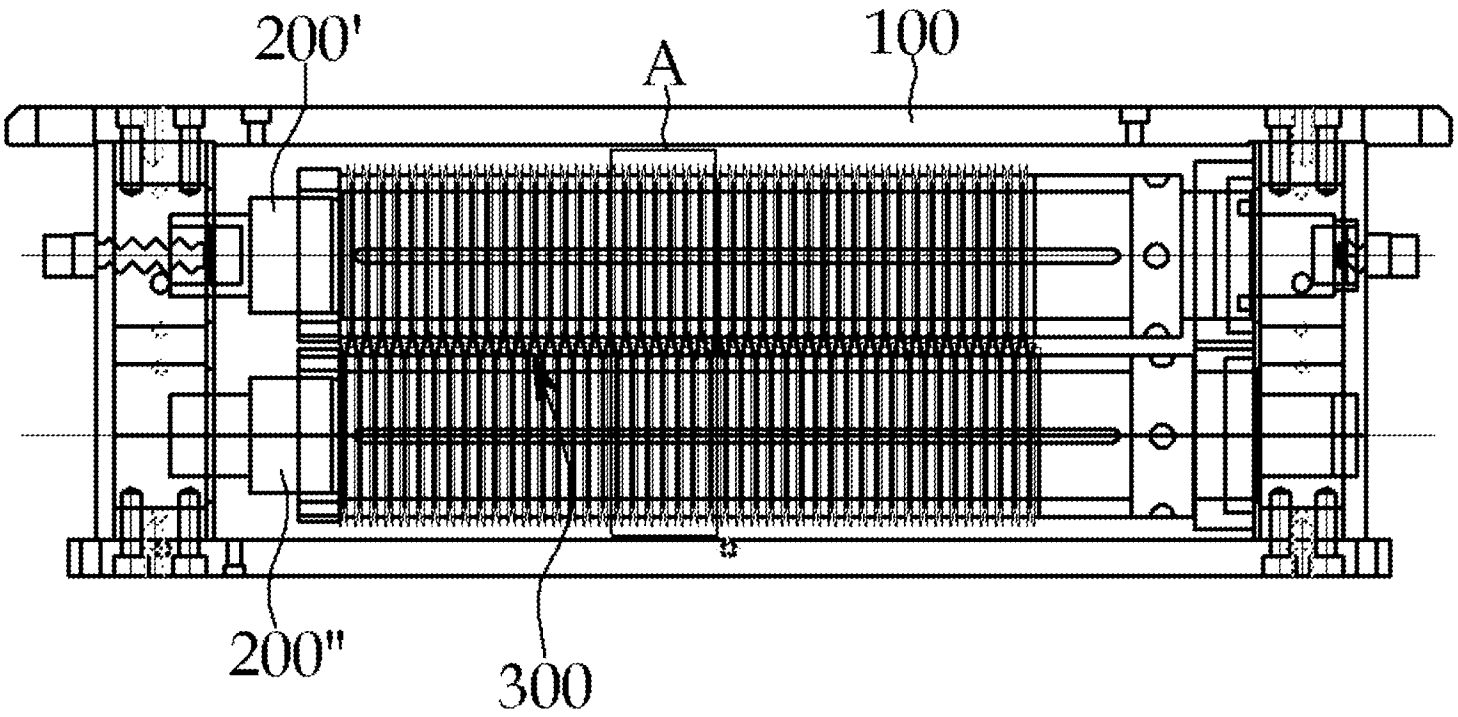
FIG. 2 is a front view showing components of the strip cutting apparatus for the diagnostic reagent kit according to the first preferred embodiment of the present invention.
Figure 3:
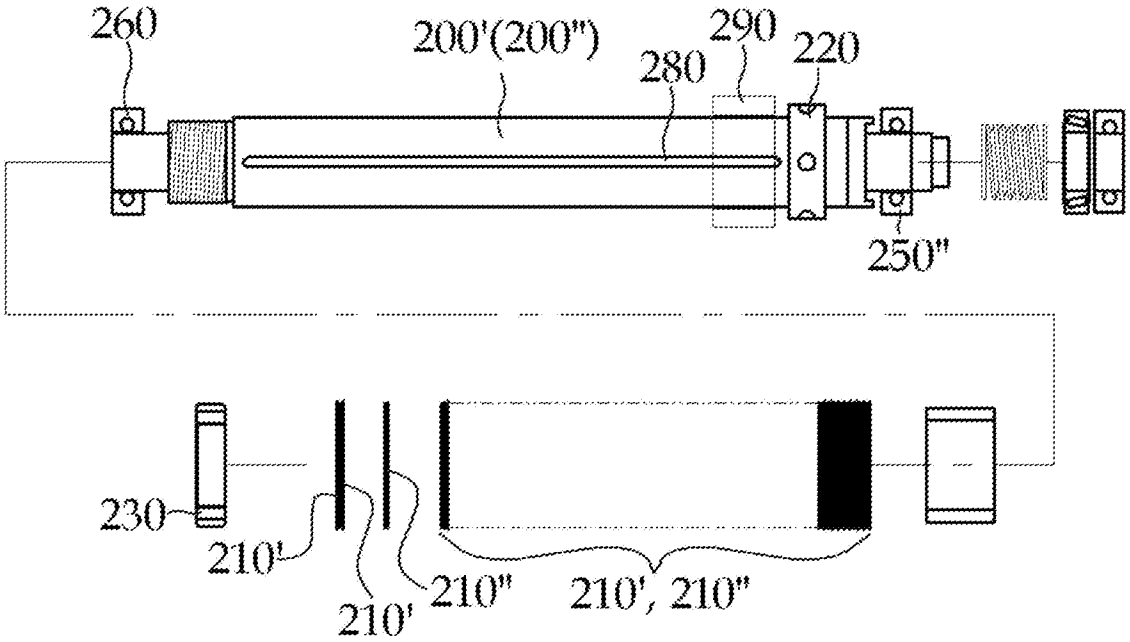
FIG. 3 is an exploded side view showing a structure of a shaft among the components of the strip cutting apparatus for the diagnostic reagent kit according to the first preferred embodiment of the present invention.

As shown in FIGS. 2 and 3, the first shaft 200' has bearings 250" and 260 at both ends to be supported to rotate in place. Moreover, the two knifes 210', which have the blades 211 facing each other, and the spacer 210" are fit in the outer circumference of the first shaft 200' alternately, and the adjusting nut 230 is fastened. In this instance, a key slot 280 is formed in the first shaft 200' and the knifes 210' and the spacer 210" are fixed not to rotate in place.

1. Knife

Figure 4:
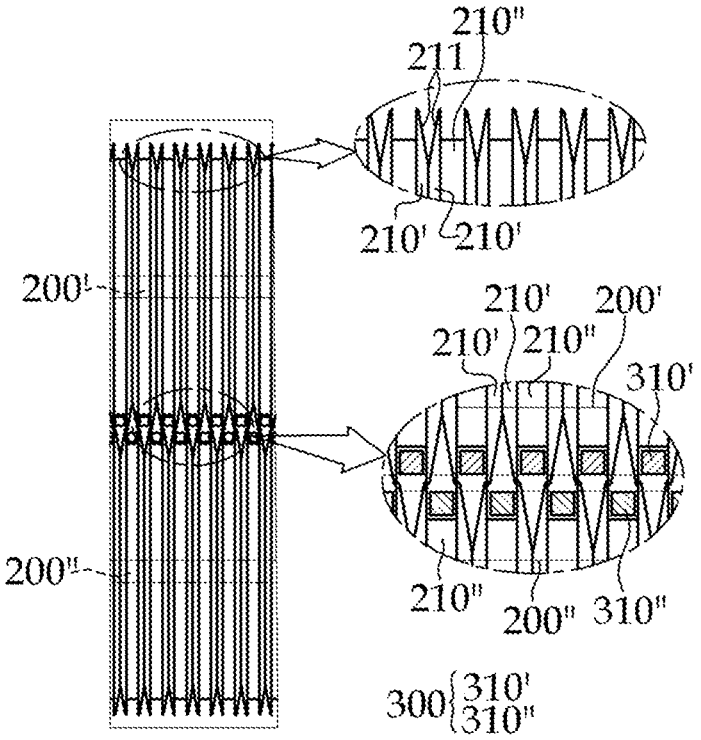
FIG. 4 is an enlarged view that enlarges a part "A" of FIG. 2 in order to show a combination relation between a first shaft and a second shaft.
Figure 5:
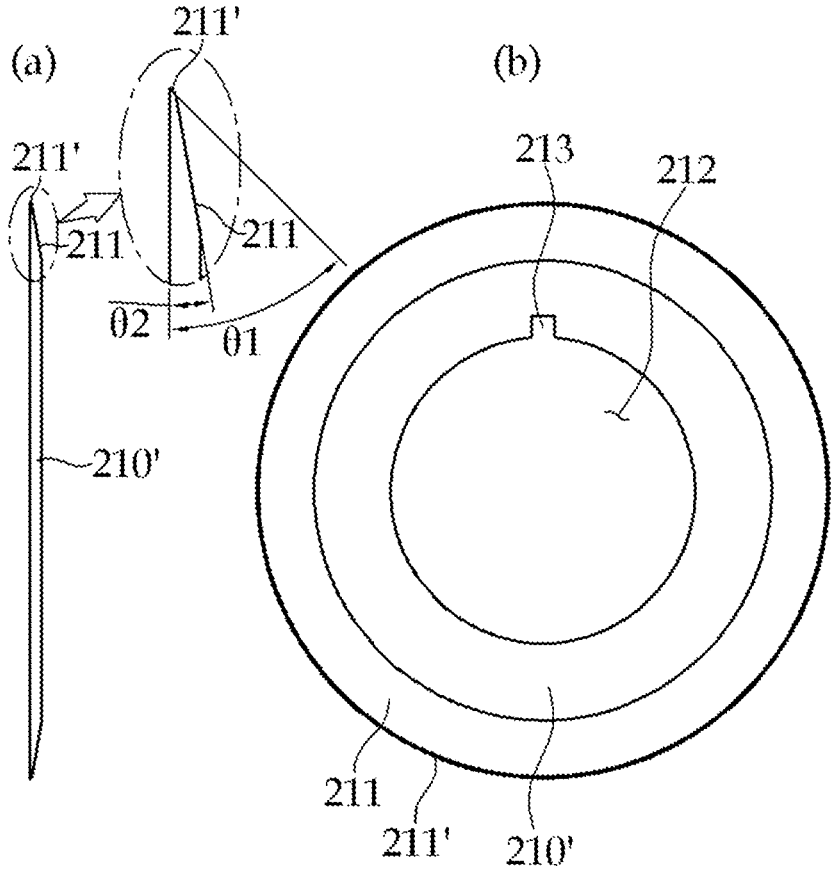
FIG. 5 is a view showing a structure of a knife according to the first preferred embodiment of the present invention, wherein FIG. 5(*a*) is a side view and FIG. 5(*b*) is a front view.

As shown in FIGS. 3 to 5, the knife 210' is formed in a disc shape. In this instance, as shown in FIG. 4, the knife 210' has the blade 211 formed at an edge of one side, so that the knives 210' respectively mounted on the first shaft 200' and the second shaft 200" can cut the diagnostic reagent 10 using shearing force like scissors.

In the preferred embodiment of the present invention, the knife 210' has a cutting edge 211' formed at an edge of the blade 211 in order to easily cut the diagnostic reagent 10 into the strips 11. In this instance, a first angle ($\theta 1$) which is formed by the cutting edge 211' is larger than a second angle ($\theta 2$) which is formed by the blade 211, so that the diagnostic reagent can be cut slowly and cleanly. Here, the first angle ($\theta 1$) is within the range of 43° to 47°, the most preferably, 45°, and the second angle ($\theta 2$) is within the range of 8° to 12°, the most preferably, 10°.

Furthermore, as shown in FIG. 5, the knife 210' has a mounting hole 212 formed in the middle of the knife 210' so that the first shaft 200' is inserted thereinto. The mounting hole 212 has another key slot 213 formed at one side so that a key fit into the key slot 280 is fit to the second key slot 213.

As shown in FIG. 4, the two knives 210' get in contact with each other in such a way that the blades 211 face each other, and the spacer 210" gets in contact with one of the two knives 210'. The two knives 210' and the one spacer 210" are continuously mounted on the first shaft 200' not to rotate. Therefore, when the diagnostic reagent 10 is cut by the knives 210', the diagnostic reagent 10 is cut into the strips 11 between the two blades 211 facing each other and between the sides facing each other without the blades 211, so that the knives can cut both sides of the strips 11 by uniform power and prevent deformation or bending of the strips 11.

2. Spacer

As shown in FIGS. 3 and 4, the spacer 210" is mounted on the first shaft 200' in such a way as to get in contact with one of the two knives 210' having the blades 211 facing each other. That is, the two knives 210' having the blades 211 facing each other and the spacer 210" are formed as a unit, and several units of the two knives 210' and the spacer 210" are fit and fixed to the first shaft 200'.

In this instance, the spacer 210" is manufactured in a disc shape and has a diameter slightly smaller than that of the knife 210', so that the knife 210' can secure a space to cut the diagnostic reagent 10. Moreover, like the knives 210', the spacer 210" must be also mounted not to rotate on the first shaft 200'. So, the spacer 210" also has a mounting hole 212 and a key slot 213, but the detailed description of the mounting hole 212 and the key slot 213 of the spacer 210" will be omitted since they are the same as the blade 210'.

In the preferred embodiment, as shown in FIG. 4, the guide member 300 is located on the spacer 210", so that the guide member 300 penetrates between the spacers 210" respectively mounted on the first shaft 200' and the second shaft 200", and the diagnostic reagent 10 is cut into strips 11 while going through between the guide members 300.

3. Adjusting Nut

Figure 6A:
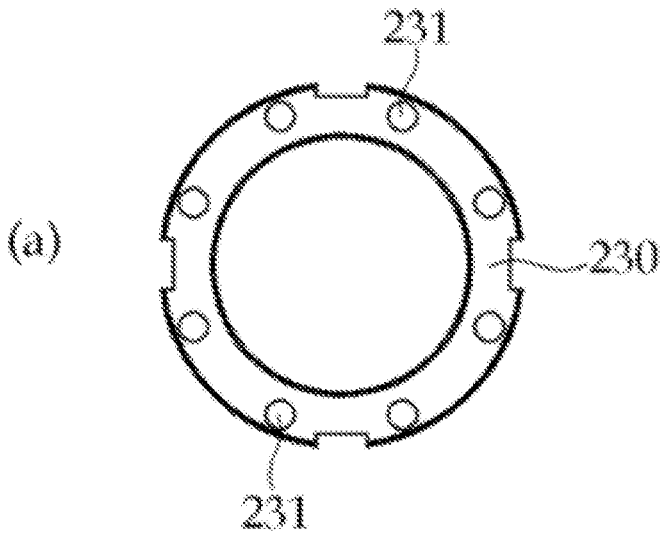
FIGS. 6(*a*) and 6(*b*) are views showing an adjusting nut according to the first preferred embodiment of the present invention, wherein FIG. 6(*a*) is a front view and FIG. 6(*b*) is a view showing an operational state where the adjusting nut adjusts concentricity.
Figure 6B:
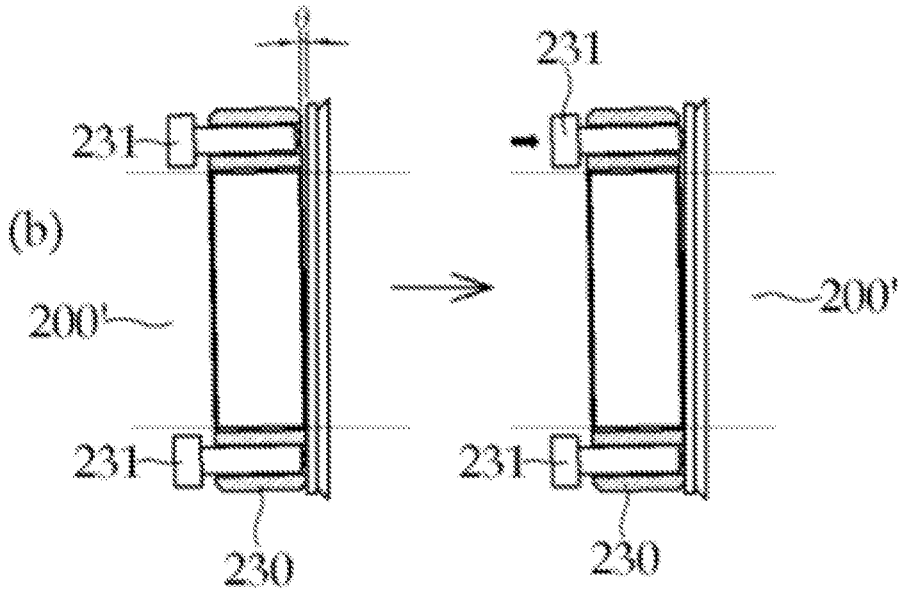
Figure 7:
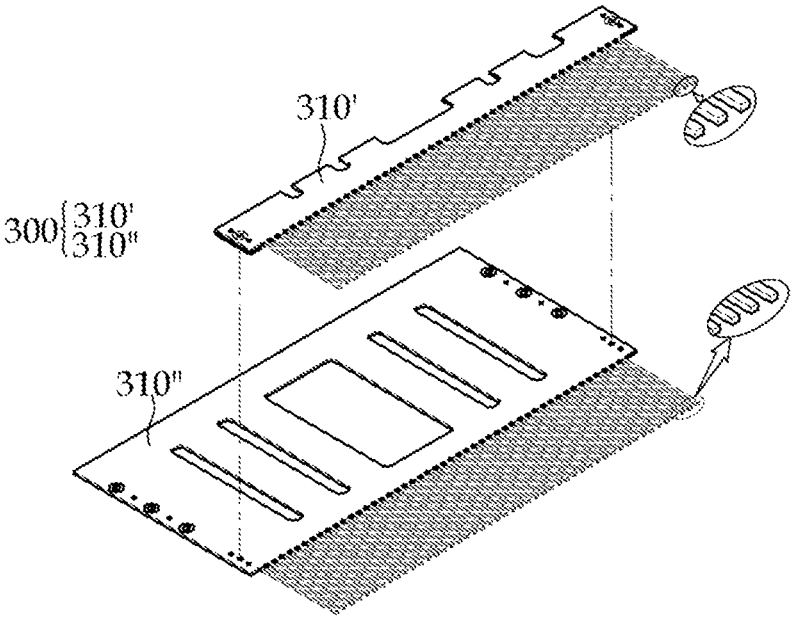
FIG. 7 is an exploded perspective view showing a structure of a guide member according to the first preferred embodiment of the present invention.

As shown in FIGS. 3 and 6(*a*), 6(*b*), the adjusting nut 230 is coupled to one side of the first shaft 200', preferably, to the first shaft 200' in the state where the knives 210' and the spacer 210" are inserted into the first shaft 200', so that the knives 210' and the spacer 210" are supported and fixed to be located side by side.

Especially, the adjusting nut 230 has at least two concentricity adjusting screws 231 to press the knives 210' and the spacer 210". As shown in FIGS. 6(*a*), 6(*b*), when the adjusting nut 230 is coupled to the first shaft 200', there may be a gap angle (θ), so the knives 210' and the spacer 210" may get out of the concentric circle even though the concentricity adjusting screws 231 are coupled stably. As described above, if the knives 210' and the spacer 210" are not in the concentric circle, a gap is formed, and the knives 210' and the spacer 210" are shaken due to the gap. Therefore, the diagnostic reagent 10 cannot be cut uniformly or the cut strips 11 may be stuck. So, even though the adjusting nut 230 does not get in close contact with the knives 210' and the spacer 210", the concentricity adjusting screws 231 makes the adjusting nut 230 come into close contact with the knives 210' and the spacer 210" while maintaining concentricity. Therefore, the present invention can cut the diagnostic reagent 10 into strips 11 according to the fixed standard and prevent defects, for instance, the cut strips 11 are stuck between the knives 210' and the spacer 210".

There are at least two concentricity adjusting screws 231 in the preferred embodiment, and preferably, the two neighboring concentricity adjusting screws 231 are arranged at a regular interval, and the most preferably, eight concentricity adjusting screws 231 are arranged at regular intervals. Because we cannot see where the gap angle (θ) is formed when the adjusting nut 230 is turned to adjust, the interval between the concentricity adjusting screws 231 gets narrow, so as to always adjust concentricity with the concentricity adjusting screw 231 which is located near.

As described above, those skilled in the art can easily know that concentricity of the knives 210' must be checked and adjusted by a concentricity gauge after the concentricity adjusting screws 231 adjust concentricity. Moreover, the concentricity adjusting screws 231 may be formed only at one side of the first shaft 200', but preferably, may be formed at both sides one by one in order to easily and accurately adjust concentricity at both sides.

Here, the unexplained reference numeral 290 indicates an interval-adjusting spacer which is fit into the first and second shafts 200' and 200". The interval-adjusting spacer is inserted and used when the need arises, for instance, when there is a need to adjust the mounting number or positions of the knives 210' and the spacer 210" according to the diagnostic reagent 10.

C. Guide Member

As shown in FIGS. 1(*a*), 1(*b*), 2, 4 and 7, the guide member 300 includes a first guide 310' and a second guide 310" and is mounted on the frame 100.

Especially, as shown in FIGS. 1(*a*), 1(*b*), 4 and 7, the first guide 310' is located on the spacer 210" mounted on the first shaft 200', and the second guide 310" is located on the spacer 210" mounted on the second shaft 200", and the first guide 310' and the second guide 310" are mounted to penetrate through the first shaft 210' and the second shaft 210". Furthermore, a space is formed between the first guide 310' and the second guide 310" as wide as to support both sides of the diagnostic reagent 10.

As shown in FIG. 1, the guide member 300 supports the diagnostic reagent 10 till the diagnostic reagent 10 is cut into the strips 11 while perfectly passing between the first shaft 210' and the second shaft 210". Therefore, as shown in FIG. 4, the guide member 300 stably supports the diagnostic reagent 10 in a rectangular space, so that the knives 210' can cut the diagnostic reagent into the strips 11 stably and the cut strips 11 can be discharged out of the first shaft 210' and the second shaft 210" without being wound on or entangled in the first shaft 210' and the second shaft 210". Therefore, the present invention can cut the strips 11 passing through the guide member 30 can be cut cleanly according to a desired standard and reduce a defective rate by preventing the cut strips 11 from being bent or wound.

As described above, the present invention can cut the diagnostic reagent into strips while supporting both sides of the diagnostic reagent by the guide member mounted to penetrate through the first shaft and the second shaft. That is, the present invention can cut the diagnostic reagent into strips of a fixed standard, and prevent edges or end portions of the cut strips from being rolled or bent by preventing the cut strips from being wound on the first shaft or the second shaft.

Embodiment 2

Figure 8:
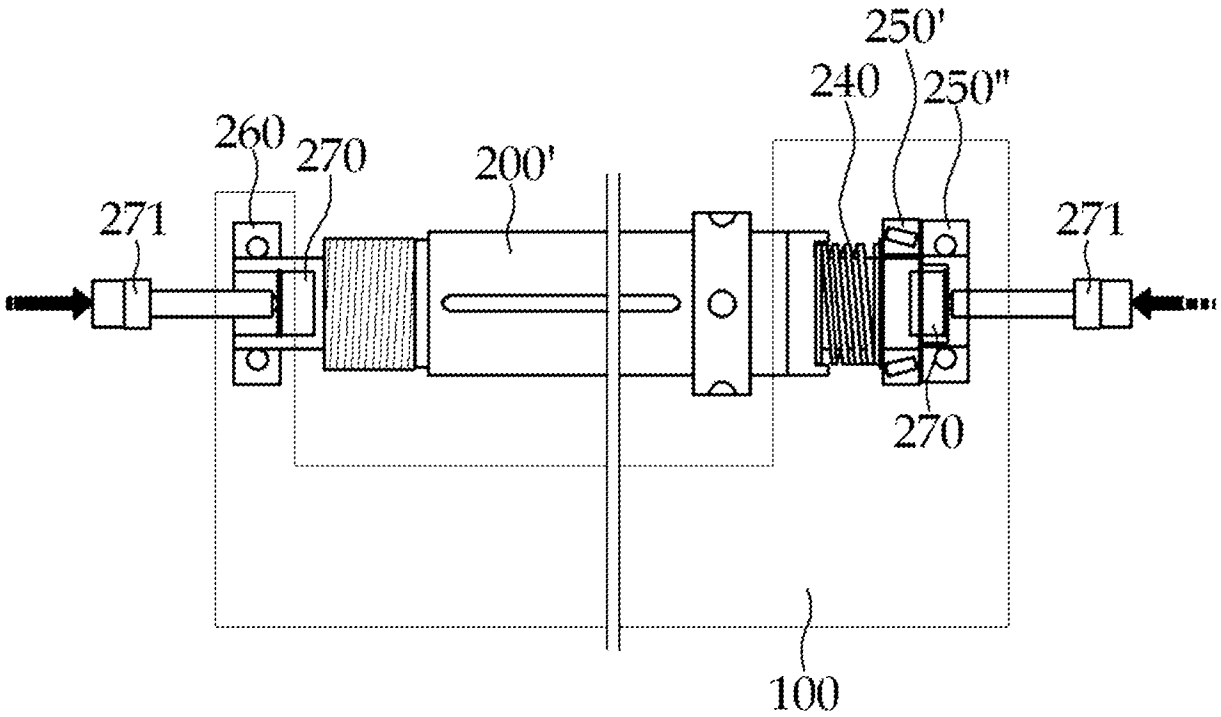
FIG. 8 is a front view showing a structure of a first shaft according to a second preferred embodiment of the present invention.

As shown in FIG. 8, a strip cutting apparatus for a diagnostic reagent kit according to a second preferred embodiment of the present invention includes the same components as the first preferred embodiment, but has a difference in that the strip cutting apparatus according to the second preferred embodiment includes additional components mounted on the first shaft 200' to move in the longitudinal direction. Therefore, now, the description will be in focus on the additional components, and the remaining components which are the same as the first preferred embodiment will not be described.

As shown in FIG. 8, the second preferred embodiment is to cut the diagnostic reagent 10 better by adjusting the interval between the knives 210' respectively mounted on the first shaft 200' and the second shaft 200" by moving the first shaft 200' in the longitudinal direction.

As shown in FIG. 8, a tapered bearing 250' is added to at least one side of the first shaft 200' so as to stably support the first shaft 200' even though the first shaft 200' moves in the longitudinal direction. In this instance, it is preferable that the tapered bearing 250' be mounted to firmly support the first shaft 200' in the frame 100 without being pushed back. Especially, a compression spring 240 is inserted between the first shaft 200' and the tapered bearing 250', in order to provide repulsive power for a buffering action in the opposite direction when pressing the first shaft 200' in the longitudinal direction. Additionally, a thrust bearing 270 is mounted at an end of the first shaft 200' to support the first shaft 200'. The thrust bearing 270 touches the adjusting screws 271, which are mounted on the frame 100 to be rotated in place.

In addition, as shown in FIG. 8, the first shaft 200' has another thrust bearing 200 mounted at the other side thereof to support the first shaft 200'. The thrust bearing 270 touches the adjusting screws 271 mounted on the frame 100. In this instance, when it is necessary to adjust the length, namely, when it is necessary to adjust the interval between the knives 210' respectively mounted on the first shaft 200' and the second shaft 200", the adjusting screws 271 are turned so that the first shaft 200' moves in the longitudinal direction and the thrust bearing 270 is pushed to adjust the length. In this instance, the first shaft 200' is adjusted in length with the buffering action by elastic support of the compression spring 240. Therefore, the first shaft 200' adjusts the interval between the knives 210' and guides the knives to return to their original locations through the buffering action even though the knives are out of joint with each other.

As described above, the present invention can stably cut the diagnostic reagent by easily adjusting the location of the knives when adjustment in location of the knives is needed since the first shaft is mounted to be supported elastically and to be adjusted in the longitudinal direction, and protect the knives and accurately cut the diagnostic reagent into a fixed form at a fixed location due to the buffering action by elastic support. In addition, the present invention can easily adjust the interval or dislocation between the knives respectively mounted on the first shaft and the second shaft since being easily adjusted in length in the longitudinal direction of the shaft supported by the thrust bearing.

What is claimed is:

1. A strip cutting apparatus for a diagnostic reagent kit which cuts a plate-shaped diagnostic reagent into several band strips in a width direction at a time, the strip cutting apparatus comprising:

a frame;

a first shaft having a disc shape, including a plurality of spacers and a plurality of knives comprising blades, which contact each other and face each other, and an adjusting nut coupled and fastened to at least one side thereof so that the knives and the spacers are secured to the first shaft, the spacers and the knives being fixed in such a way that two knives and one spacer are fit onto the first shaft alternately not to rotate;

a second shaft having a disc shape, including a plurality of spacers and a plurality of knives comprising blades, which contact each other and face each other, and an adjusting nut coupled and fastened to at least one side thereof so that the knives and the spacers are secured to the second shaft, the spacers and the knives being fixed in such a way that two knives and one spacer are fit onto the second shaft alternately not to rotate; and a guide member, which includes a first guide mounted on the spacer of the first shaft and a second guide mounted on the spacer of the second shaft, the guide member supporting a diagnostic reagent so that the diagnostic reagent is cut when the diagnostic reagent goes between the first shaft and the second shaft, wherein the knives are mounted to rotate on the frame to cut the diagnostic reagent into several strips by shearing force when the first shaft and the second shaft rotate on the frame at the same time, and wherein at least two concentricity adjusting screws are coupled to the adjusting nuts of the first shaft and the second shaft in a threaded type in order to adjust concentricity of the knives and the spacers by changing a rotation amount of the adjusting screws into a straight line to push the knives and the spacers in a width direction.

2. The strip cutting apparatus according to claim 1, wherein each of the plurality of knives have a cutting edge at a first angle which is larger than a second angle which is formed by the blade.

3. The strip cutting apparatus according to claim 2, wherein the first angle is within the range of 43° to 47°, and the second angle is within the range of 8° to 12°.

4. The strip cutting apparatus according to claim 3, wherein a compression spring, a tapered bearing, a bearing and a thrust bearing are mounted on one side of the first shaft in order, the thrust bearing has an adjusting screw mounted on the first shaft, and the adjusting screw is turned so that the first shaft moves in a longitudinal direction and the thrust bearing is pushed to adjust an interval between the knives, and wherein another bearing for supporting rotation and longitudinal movement of the first shaft, another adjusting screw mounted on the frame, and another thrust bearing for rotatably supporting the first shaft according to in-place rotation of the adjusting screw are mounted on the other side of the first shaft.

5. The strip cutting apparatus according to claim 2, wherein a compression spring, a tapered bearing, a bearing and a thrust bearing are mounted on one side of the first shaft in order, the thrust bearing has an adjusting screw mounted on the first shaft, and the adjusting screw is turned so that the first shaft moves in a longitudinal direction and the thrust bearing is pushed to adjust an interval between the knives, and wherein another bearing for supporting rotation and longitudinal movement of the first shaft, another adjusting screw mounted on the frame, and another thrust bearing for rotatably supporting the first shaft according to in-place rotation of the adjusting screw are mounted on the other side of the first shaft.

6. The strip cutting apparatus according to claim 1, wherein a compression spring, a tapered bearing, a bearing and a thrust bearing are mounted on one side of the first shaft in order, the thrust bearing has an adjusting screw mounted on the first shaft, and the adjusting screw is turned so that the first shaft moves in a longitudinal direction and the thrust bearing is pushed to adjust an interval between the knives, and wherein another bearing for supporting rotation and longitudinal movement of the first shaft, another adjusting screw mounted on the frame, and another thrust bearing for rotatably supporting the first shaft according to in-place rotation of the adjusting screw are mounted on the other side of the first shaft.

* * * * *